US008132332B2

(12) United States Patent
Tautscher et al.

(10) Patent No.: US 8,132,332 B2
(45) Date of Patent: Mar. 13, 2012

(54) CUTTING DEVICE

(75) Inventors: Manfred Tautscher, Ferlach (AT); Rene Wadsack, Klagenfurt (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 406 days.

(21) Appl. No.: 12/298,920

(22) PCT Filed: Apr. 26, 2007

(86) PCT No.: PCT/IB2007/051549

§ 371 (c)(1),
(2), (4) Date: Oct. 29, 2008

(87) PCT Pub. No.: WO2007/125491

PCT Pub. Date: Nov. 8, 2007

(65) Prior Publication Data

US 2009/0199413 A1 Aug. 13, 2009

(30) Foreign Application Priority Data

May 1, 2006 (EP) ..... 06113338

(51) Int. Cl.
*B26B 19/02* (2006.01)

(52) U.S. Cl. ..... 30/43.92; 30/208

(58) Field of Classification Search ..... 30/43.7–44, 30/194, 195, 199, 208, 209, 210
See application file for complete search history.

(56) References Cited

U.S. PATENT DOCUMENTS

| | | | | | |
|---|---|---|---|---|---|
| 3,872,587 | A * | 3/1975 | Wellinger | 30/43.92 |
| 3,949,469 | A * | 4/1976 | Brauss | 30/43.91 |
| 4,159,566 | A * | 7/1979 | Patrin | 30/220 |
| 4,594,778 | A * | 6/1986 | Dona et al. | 30/43.9 |
| 4,709,475 | A * | 12/1987 | Phung | 30/31 |
| 5,632,087 | A * | 5/1997 | Motohashi et al. | 30/43.92 |
| 6,226,870 | B1 * | 5/2001 | Barish | 30/43.6 |
| 6,308,415 | B1 * | 10/2001 | Sablatschan et al. | 30/43.92 |
| 6,933,630 | B2 * | 8/2005 | Kraus et al. | 30/43.7 |
| 7,053,507 | B2 * | 5/2006 | Kobayashi et al. | 310/36 |
| 2005/0217118 | A1 * | 10/2005 | Mah | 30/261 |
| 2005/0223565 | A1 * | 10/2005 | Rutovic | 30/195 |
| 2007/0193034 | A1 * | 8/2007 | Oh | 30/43.91 |
| 2009/0019706 | A1 * | 1/2009 | Werner et al. | 30/233.5 |
| 2009/0044411 | A1 * | 2/2009 | Cotant | 30/233.5 |
| 2009/0265938 | A1 * | 10/2009 | Janny et al. | 30/42 |
| 2011/0094107 | A1 * | 4/2011 | Ring et al. | 30/42 |

FOREIGN PATENT DOCUMENTS

| | | | |
|---|---|---|---|
| DE | 3830934 | A1 * | 3/1990 |
| DE | 4334794 | A1 * | 4/1995 |
| EP | 0914234 | B1 | 5/1999 |
| FR | 2130832 | A | 11/1972 |
| JP | 53146854 | A * | 12/1978 |
| JP | 10108986 | A * | 4/1998 |
| JP | 2001170374 | A * | 6/2001 |
| JP | 2006296702 | A * | 11/2006 |
| WO | WO 8901392 | A1 * | 2/1989 |
| WO | WO 9847673 | A1 * | 10/1998 |
| WO | 2005075160 | A1 | 8/2005 |
| WO | 2006000935 | A1 | 1/2006 |
| WO | WO 2007125491 | A1 * | 11/2007 |
| WO | WO 2007148270 | A2 * | 12/2007 |

* cited by examiner

*Primary Examiner* — Jason Daniel Prone
(74) *Attorney, Agent, or Firm* — Sherry Austin

(57) ABSTRACT

A cutting device with two toothed blades arranged to be moveable with respect to each other includes a magnetic arranged to press both blades together.

9 Claims, 4 Drawing Sheets

CUTTING DEVICE

Figure 1C:
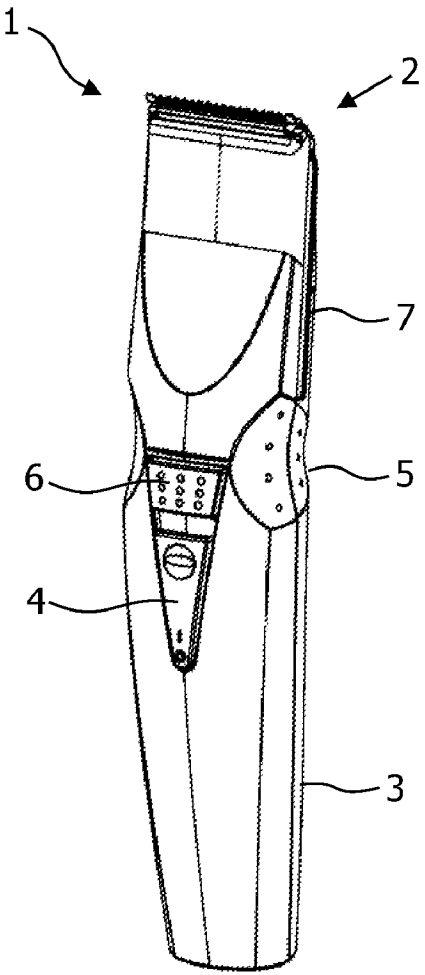

The present invention relates to a cutting device for a cutting apparatus, in particular a hair-cutting apparatus.

The present invention further relates to a hair-cutting apparatus with a cutting device according to the present invention.

A hair-cutting apparatus usually has a cutting device with two blades moved relatively to one another with help of a motor. The cutting device is normally mounted on a casing of the hair-cutting apparatus housing the motor or batteries as power supply for the hair-cutting device, wherein the casing also serves as handle for hand-held hair-cutting systems.

The hairs to be cut are caught between the teeth of the blades and severed due to the reciprocating movement of the blades. Usually, only one of the blades is reciprocating while the other one is stationary. For safety reasons, the stationary blade is often chosen to be next to the skin with hair to be cut, thus shielding the skin from the reciprocating blade to avoid injuries.

EP 0 914 234 B1 describes a hair-cutting apparatus with a toothed cutting device. The toothed cutting device comprises two toothed cutters with cutter-tooth rows. Both cutters are reciprocatingly drivable relative to another. Both cutters lie against one another in the area of their respective cutter-tooth rows. To have both cutters lie properly against one another, the cutting device comprises a steel spring device. The spring device comprises a substantially U-shaped central portion, two wound spring portions at the limbs of the U-shaped portion, and two bent end portions, such that the central portion and the end portions tend to move towards one another. The spring device is arranged between the cutters such that they are pressed towards one another with a given spring force. If the gap between both cutters were too large, the hair caught between the cutters' teeth would not get severed.

It is an object of the present invention to further simplify the cutting device and the hair-cutting apparatus of the state of the art.

In a first aspect of the present invention, this object is achieved by a cutting device, in particular for a hair-cutting apparatus, with two toothed blades arranged to be moveable with respect to each other, this cutting device comprising magnetic means arranged to press both blades together.

By utilizing magnetic means, e.g. magnetic units or magnetized components next to the blades or magnetized blades to press the blades against one another, the design of the cutting device is simplified in that no spring devices, be it e.g. flat springs or leg springs, need anymore to be provided and accommodated in the cutting device. This provides a new design freedom for the cutting device.

A major advantage of the using magnetic means for pressing the blades together is that no friction or, in case of a leg spring, no stiffness has to be overcome for the reciprocating movement of the blades. Thus the energy consumption of a drive unit or some cutting apparatus for driving the blades is significantly lowered. More energy can be used for the cutting or severing process as such and improve the cut quality.

The cutting device according to the present invention is particularly well suited for a hair-cutting apparatus, but may as well be used with any cutting apparatus relying on the principle of reciprocating blades such as a cutting apparatus for cutting grass or trimming hedges, or for cutting paper, textiles or fibers, for example.

Preferably, the cutting device comprises a magnetic element arranged on one of the blades, while the other blade contains magnetizable material. This has, on the one hand, the advantage that the magnetic element can be chosen depending on the magnetic force needed, and, on the other hand, that the amount of supplemental space and additional components is reduced, as one of the blade is itself a magnetic means. If one uses one reciprocating blade and one stationary blade, advantageously, the magnetic unit is attached to the stationary blade to further reduce energy consumption, because the magnetic unit has not to be moved, too.

In preferred embodiments, the cutting device comprises a linkage element connected to one of the blades for driving it to a reciprocating movement, whereas the other blade is stationary, and wherein a magnetic element is arranged on the moveable blade, while the stationary blade contains magnetizable material. The linkage element may be used to couple the cutting device to the drive unit of a cutting apparatus, especially of a hair-cutting apparatus.

Preferably, the linkage element, the reciprocating blade and the magnetic element are arranged such that the linkage element encompasses the magnetic element to fix it against the reciprocating blade. Thus, the position of the magnetic element with respect to the moveable blade is well defined.

Advantageously, the linkage element is arranged between both blades. This leads to a compact design of the cutting device, as the need for space is reduced. Furthermore, the linkage element may be used to define the distance of the toothed blades at their teeth tips.

Preferably, the linkage element comprises a transmission element. The transmission element has the function of an interface between the linkage element of the cutting device and some transmission system of a cutting apparatus, particularly of a hair-cutting apparatus, transmitting and eventually converting the movement of the drive unit of the apparatus into a linear, reciprocating movement. Providing the transmission element at one of the ends of the linkage element allows for more freedom of design of the transmission unit compared with a transmission element in the middle of the linkage element.

In preferred embodiments, an air gap is provided between the magnetic means and a blade. This is particularly advantageous to set the magnetic force acting on the blade, as the magnetic force depends on the dimensions and characteristics of the magnetic means as well as on the height of the air gap. For different embodiments intended to different uses, different magnetic forces may be necessary. To reduce the design and production cost, the air gap is a very convenient parameter to change.

In a further aspect of the present invention, this object is achieved by a hair-cutting apparatus comprising a cutting device according to the present invention.

By utilizing magnetic means, e.g. magnetic units or magnetized components next to the blades or magnetized blades to press the blades against one another, not only for the cutting device but also for the hair-cutting apparatus a new freedom of design is provided. The reduced energy consumption allows using smaller batteries and/or smaller drive units, e.g. smaller motors and smaller transmission systems. The freedom of design is further enhanced by the possibility of a smaller cutting device and by the possibility of the transmission element of the linkage element of the cutting device being not only in the middle, but also on one of the ends of the linkage element.

The hair-cutting apparatus may be of any known kind of hair-cutting apparatus, e.g. for human hair-cutting for both men and women on all body areas, be it beard, head or full body grooming, for personal or professional use, for pet clipper systems, or for surgical one-use trimmers that are used for removing hair from body areas before a surgery. Other possibilities are combined shaver-/hair-cutting apparatus having in addition to a cutting device a shaving unit, e.g. a rotor shaver or foil shaver.

The reduced energy consumption due to magnetic means for pressing together the blades of the hair-cutting apparatus' cutting device leads to longer running times of the hair-cutting apparatus. This as well as the now possible smaller design of cutting device and hair-cutting apparatus reduces costs for production and for operation. The consumer will also appreciate that a smaller hair-cutting apparatus is easier to handle.

Figure 1B:
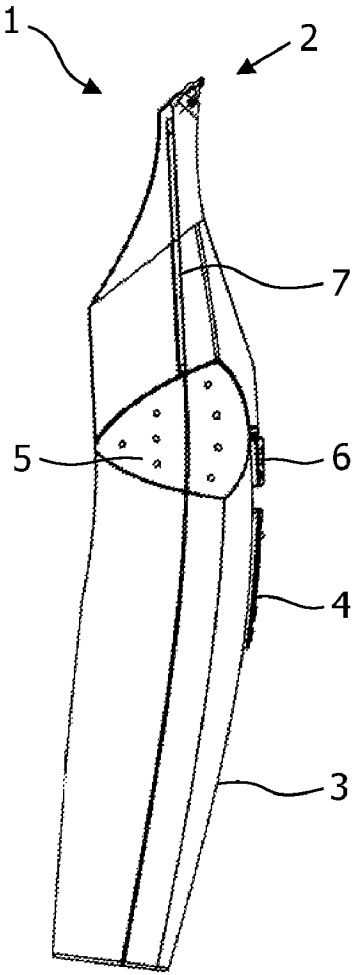
Figure 1A:
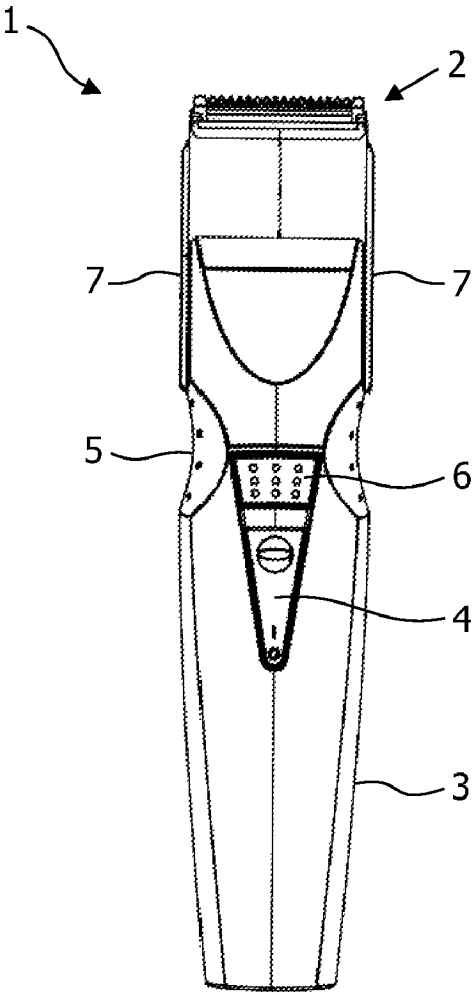
Figure 2A:
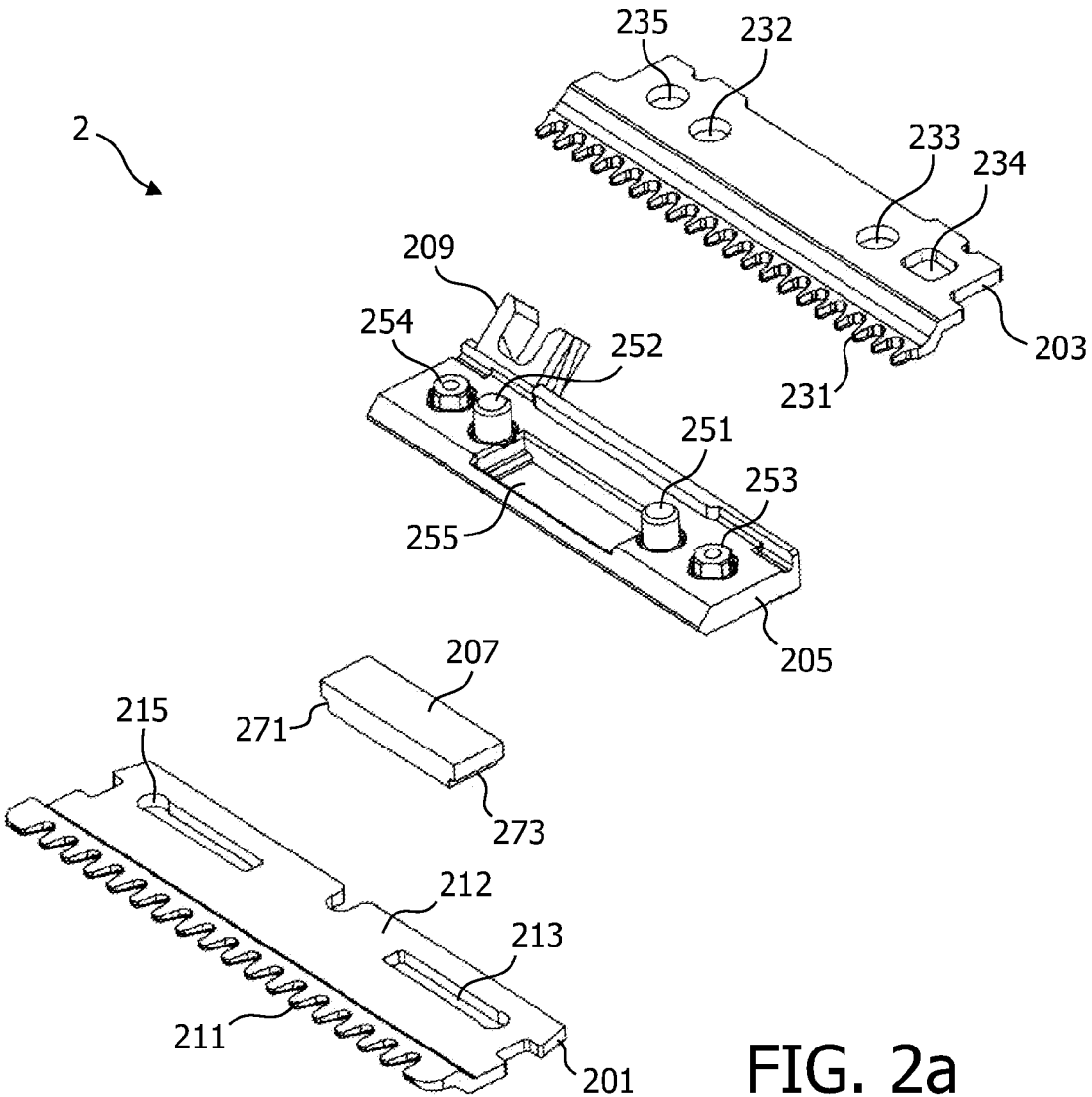
Figure 2C:
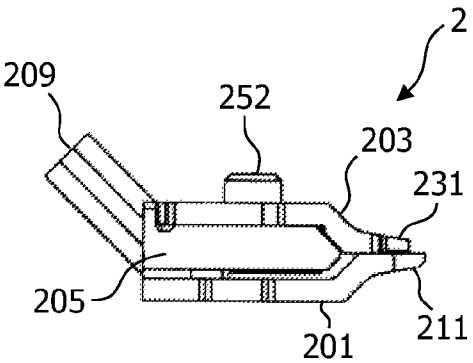
Figure 2B:
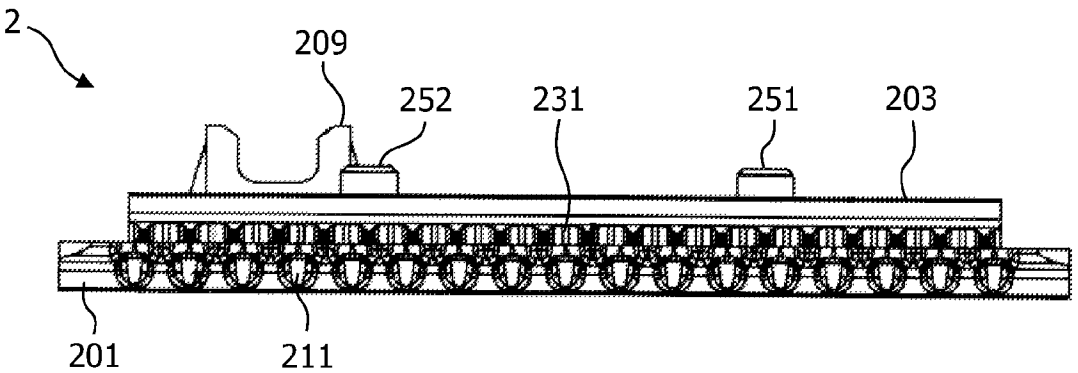
Figure 2D:
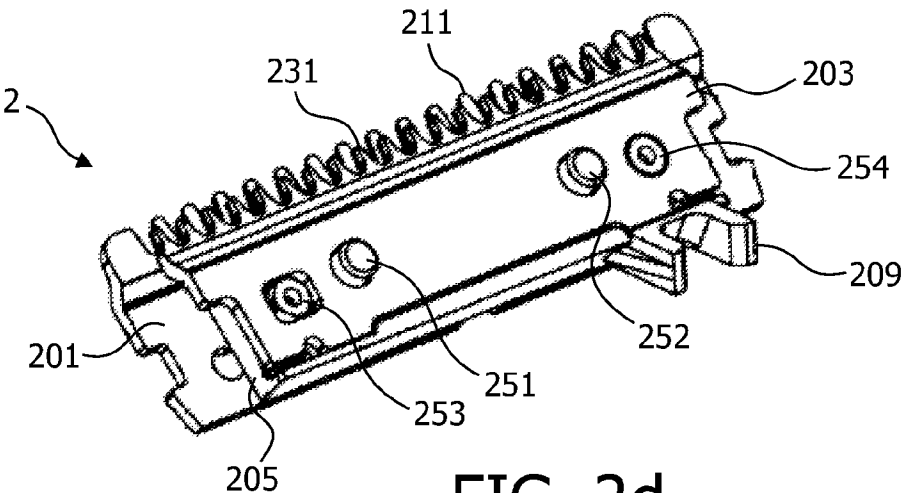
Figure 2F:
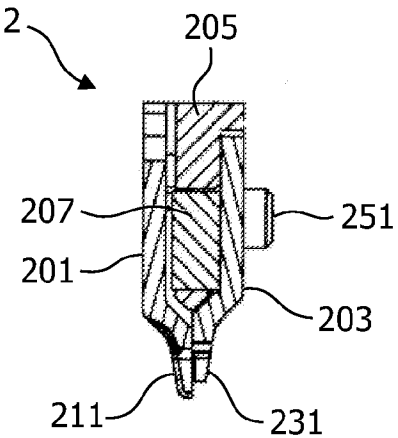
Figure 2E:
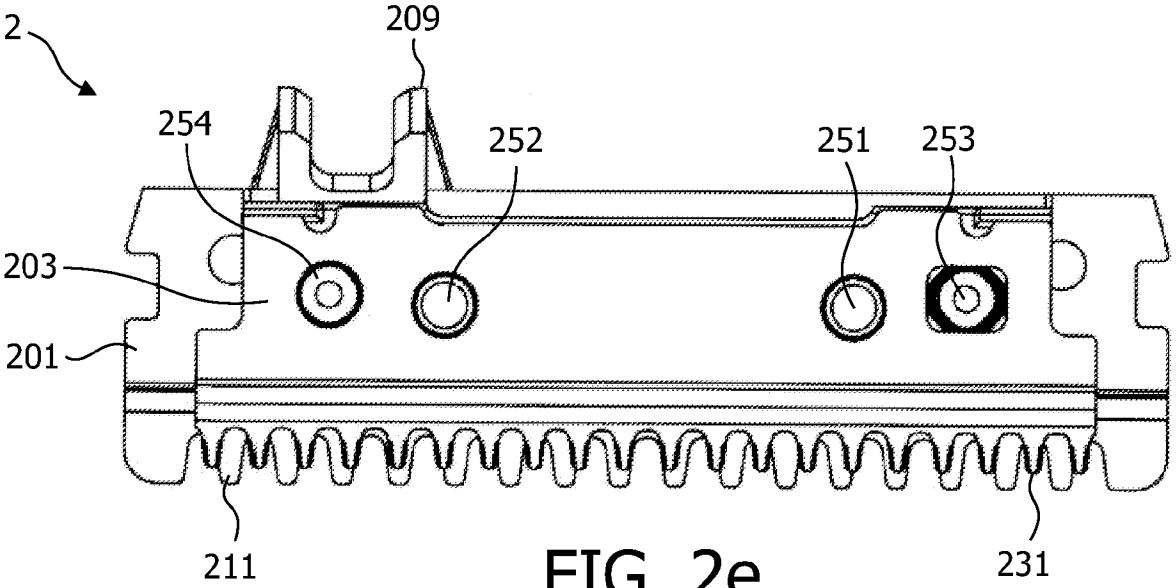
Figure 3:
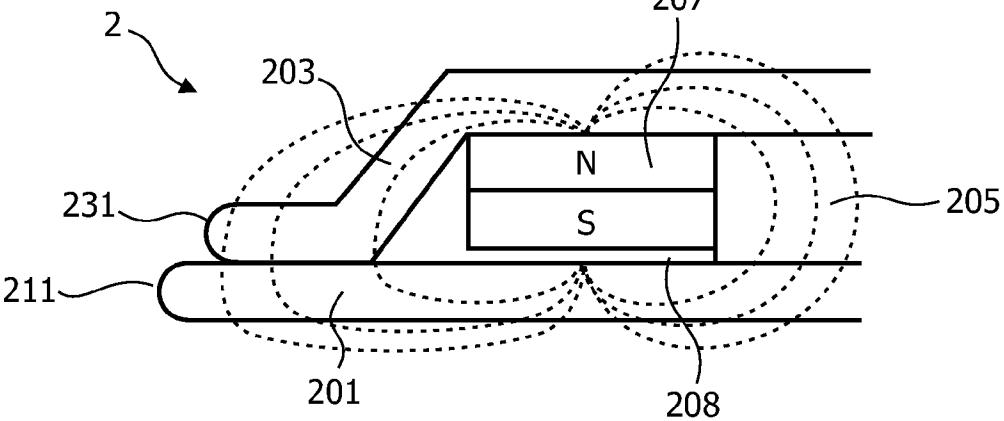

A detailed description of the invention is provided below. Said description is provided by way of a non-limiting example to be read with reference to the attached drawings in which:

FIGS. 1*a-c* show a preferred embodiment of the hair-cutting apparatus according to the present invention;

FIGS. 2*a-f* illustrate different views of a preferred embodiment of the cutting device according to the present invention; and FIG. 3 illustrates schematically the function of the magnetic means in the cutting device according to the present invention.

FIGS. 1*a, b, c* show a hair-cutting apparatus 1, which is often referred to as a hair trimmer. The hair trimmer 1 has a casing 3, which has been given a slightly curved and angled shape as well as grips 5 in order to achieve an ergonomically favorable construction. In a dorsal area of the casing 3 a button 6 has been arranged to unlock a cutting unit 2 mounted on the casing 3 to detach it from the casing 3 to replace it with other units, such as e.g. a cutting unit with different dimensions or a foil-shaving unit. The casing 3 of the hair trimmer 1 has two guide ways 7 adapted to receive guide members of a comb attachment (not shown in FIGS. 1*a-c*) at different positions to allow different hair cut lengths.

In a central area of the casing 3, a further slide button 4 has been arranged. This slide button 4 is slideable between two positions to switch on or off an electric drive motor accommodated inside the casing 3. The drive motor, together with a transmission system inside the casing 3, are adapted to drive the blades of a cutting device 2. The drive motor is powered by a rechargeable battery housed in the casing 3 as well. It will be noted that other means of powering the motor are possible such as using an external power supply or a primary battery.

Due to utilizing magnetic means, e.g. magnetic units or magnetized components next to the blades or magnetized blades to press the blades against one another, as will be explained with respect to a preferred embodiment illustrated in FIGS. 2, 3, the design of the cutting device is simplified in that no spring devices, be it e.g. flat springs or leg springs, need anymore to be provided and accommodated in the cutting device. This provides a new design freedom for the cutting device as well 2 as for the hair trimmer 1.

By using magnetic means for pressing the blades together is that no friction or, in case of a leg spring, no stiffness has to be overcome for the reciprocating movement of the blades. Thus the energy consumption of the drive motor is significantly lowered. More energy can be used for the cutting or severing process as such and improve the cut quality. The reduced energy consumption also leads to longer running times of the hair trimmer 1. The reduced energy consumption further allows using smaller batteries and a smaller drive motors and transmission system. In the example illustrated in FIG. 1, this leads to a slim and light design of the casing 3 and the cutting device 2, which makes the hair trimmer particularly easy to handle.

A preferred embodiment of the cutting device 2 is shown in exploded view in FIG. 2*a*, in a front view in FIG. 2*b*, in a side vide in FIG. 2*c*, in a perspective view in FIG. 2*d*, in a top view in FIG. 2*e*, and in a cut view in FIG. 2*f*.

The main components of the cutting device 2 are the two blades 201, 203. Both blades 201, 203 have teeth 211, 231. Hair to be cut is caught between the teeth 211, 231 and is severed by a reciprocating movement of both blades 201, 203 with respect to each other. In the present example the lower blade 201 is stationary and called guard, because its additional function is to guard the skin of being injured by the reciprocating, upper blade 203, also called cutter. Both blades are made of steel and, thus, are magnetizable.

The cutter 203 is mounted on a linkage element 205, also called driving bridge. The driving bridge 205 has an opening with protrusions 255 (only one visible in FIG. 2*a*) to accommodate a magnet 207 having recesses 271, 273 complementary to the protrusions 255 at its lower edges to be encompassed by the driving bridge 205. In addition, the driving bridge 205 has two shafts 251, 252 and two hooked, engaging or snap shafts 253, 254 to be accommodated and snap in the appropriate openings 232, 233, 234, 235 in the cutter 203. The cutter 203 is mounted on the driving bridge 205 after the magnet 207 has been placed in the driving bridge 205. By integrating the magnet 207 in the driving bridge 205, the position of the magnet 207 in the cutting unit 2 is well defined and fixed. Two avoid an unintentional dismounting of the driving bridge 205 and the cutter 203, the two shafts 251, 252 can be warm riveted.

The driving bridge 205 has two rips on its lower side as well (not visible) to be snapped into the slots 213, 215 of the guard 201. The slots 213, 215 have a guiding function for the reciprocating movement of the driving bridge 205, and with it of the magnet 207 and the cutter 203. To ensure a smooth and frictionless reciprocating movement, the gliding surface 212 of the guard 201 for the driving bridge 205 is ground and an air gap 208 (see FIG. 3) is provided between the magnet 207 and the guard 201. The air gap 208 defines the force acting between the cutter 203 and the guard 201.

The driving bridge 205 has a transmission element 209 on one of its ends. The transmission element 209 is an interface between the cutting device 2 and the drive unit of the hair trimmer, the drive unit having a motor producing a revolving movement and a transmission system converting the revolving movement into a linear, reciprocating movement. The transmission element 209 transmits the linear, reciprocating movement to the driving bridge in order to move the cutter 203 in a reciprocating way with respect to the guard 201. It will be noted that the transmission element 209 may be arranged somewhere between the ends of the driving bridge 205 in other embodiments.

For an efficient cutting process, it is important that the guard 201 and the cutter 203 are well pressed against each other. Otherwise, the hair to be cut and that is caught between the teeth 211, 231 of the guard 201 and the cutter 203 would slip between the teeth 211, 231 without being severed. As schematically illustrated in FIG. 3, both blades 201, 203 are pressed together using magnetic means 207.

In the present example, a magnet 207 with a north pole N and south pole S generating a magnetic field (dotted lines) is arranged in between the cutter 203 and the guard 201. The cutter 203 and the guard 201 being of steel, both, guard 201 and cutter 203, are attracted by the magnet 207 and, thus, pressed together in particular in the area of the teeth 211, 213. In other area, there is an air gap 208 between the cutter 203 and the guard 201 to avoid any friction during operation that would increase the energy consumption. The height of the air gap 208 will be chosen depending on the dimensions of the magnet 207 and the magnetic force one needs to act between the magnet 207 and the blades 201, 203. In the present example, the height of the air gap 208 is in the range of tenth of millimeters. By using blades 201, 203 both being of magnetizable material, the magnet 207 is more efficiently attached to the cutter 203 and the guard 201 and the cutter are more efficiently pressed together.

It will be noted that various other possibilities of using magnetic means could be utilized as well. E.g., a magnet could be attached to each blade, or a magnet could be attached to the guard, the cutter being magnetizable, etc. Besides blades made of steel, blades containing enough amount of e.g. nickel or cobalt instead of iron could be used as well.

It will further be noted, that one major function of the driving bridge 205 in addition to driving the cutter 203 and positioning the magnet 207, is to properly position of the cutter 203 with respect to the guard 201, in particular to achieve the desired distance between the tips of the teeth 211 of the guard 201 and the tips of the teeth 231 of the cutter 203. This distance is an important parameter when both improving the cut efficiency and reducing the probability of skin injuries due to the cutting.

Although having described several preferred embodiments of the invention, those skilled in the art would appreciate that various changes, alterations, and substitutions can be made without departing from the spirit and concepts of the present invention. The invention is, therefore, claimed in any of its forms or modifications with the proper scope of the appended claims. For example various combinations of the features of the following dependent claims could be made with the features of the independent claim without departing from the scope of the present invention. Furthermore, any reference numerals in the claims shall not be construed as limiting scope.

List of Reference Numerals:

| | |
|---|---|
| 1 | hair trimmer |
| 2 | cutting device |
| 3 | casing |
| 4 | button |
| 5 | grip |
| 6 | button |
| 7 | guide way |
| 201 | guard |
| 203 | cutter |
| 205 | driving bridge |
| 207 | magnet |
| 208 | air gap |
| 209 | transmission element |
| 211 | teeth |
| 212 | gliding surface |
| 213, 215 | slot |
| 231 | teeth |
| 232, 233, 234, 235 | opening |
| 251, 252 | shaft |
| 253, 254 | hooked shaft |

-continued

List of Reference Numerals:

| | |
|---|---|
| 255 | protrusion |
| 271, 273 | recess |
| N | north pole |
| S | south pole |

The invention claimed is:

1. A cutting device comprising:

two toothed blades including a stationary blade and a moveable blade, wherein the moveable blade is arranged to be moveable with respect to the stationary blade;

a motor for driving the moveable blade through a linkage element to a reciprocating movement in a plane parallel to the stationary blade; and a magnet configured to press the two toothed blades together, wherein the linkage element includes a recess for accommodating the magnet, and wherein a wall of the linkage element around the recess includes a protrusion for mating with a recess of the magnet such that a first surface of the magnet is in fixed contact with the moveable blade and a second surface of the magnet opposite the first surface is raised above the stationary magnet for providing an air gap between the stationary magnet and the second surface of the magnet.

2. The cutting device of claim 1, wherein the first surface is a north pole of the magnet and the second surface is a south pole of the magnet.

3. A cutting device comprising:

two toothed blades including a stationary blade and a moveable blade, wherein the moveable blade is arranged to be moveable with respect to the stationary blade;

a motor for driving the moveable blade through a linkage element to a reciprocating movement in a plane parallel to the stationary blade; and a magnet configured to press the two toothed blades together, wherein the linkage element, the moveable blade and the magnet are arranged such that the linkage element encompasses the magnet to fix the magnet against the moveable blade.

4. The cutting device according to claim 3, wherein the stationary blade contains magnetic material.

5. The cutting device according to claim 3, wherein the linkage element is arranged between the two toothed blades.

6. The cutting device according to claim 3, wherein the linkage element has one end that comprises a transmission element.

7. The cutting device according to claim 3, wherein the magnet is separated from the stationary blade by an air gap.

8. The cutting device according to claim 3, wherein the cutting device is a hair-cutting apparatus.

9. The cutting device of claim 3, wherein the linkage element includes a recess for accommodating the magnet.

* * * * *